US006680465B2

(12) United States Patent
O'Connor

(10) Patent No.: US 6,680,465 B2
(45) Date of Patent: Jan. 20, 2004

(54) HEATING CABLE

(75) Inventor: Jason O'Connor, Stockport (GB)

(73) Assignee: Heat Trace LTD, Stockport (GB)

( * ) Notice: Subject to any disclaimer, the term of this patent is extended or adjusted under 35 U.S.C. 154(b) by 126 days.

(21) Appl. No.: 10/010,328

(22) Filed: Oct. 19, 2001

(65) Prior Publication Data

US 2002/0074328 A1 Jun. 20, 2002

(30) Foreign Application Priority Data

Oct. 19, 2000 (GB) ..... 0025734
Dec. 30, 2000 (GB) ..... 0031857

(51) Int. Cl.[7] ..... H05B 3/56
(52) U.S. Cl. ..... 219/544; 219/548; 219/549
(58) Field of Search ..... 219/528, 541, 219/505, 504, 535, 539, 483, 549; 338/208, 214; 361/106; 29/611, 728; 174/102 D, 25 R; 72/38, 46, 258

(56) References Cited

U.S. PATENT DOCUMENTS 3,557,301 A * 1/1971 Priaroggia ..... 174/102 D
3,986,377 A * 10/1976 Priaroggia ..... 72/38
4,100,673 A * 7/1978 Leavines ..... 29/611
4,891,500 A * 1/1990 Bloore ..... 219/505
5,245,161 A * 9/1993 Okamoto ..... 219/549
6,005,232 A * 12/1999 Janvrin et al. ..... 219/549

OTHER PUBLICATIONS

Technical Note, "*Electric trace heating for the process industries*," A joint ETHIC Technology publication, Capenhurst Chester CH16ES, Registered in England 256613, EATL 1167/07.93, ISBN 1–874290–06–7.

* cited by examiner

*Primary Examiner*—Tu Ba Hoang
(74) *Attorney, Agent, or Firm*—Conley Rose, P.C.

(57) ABSTRACT

A mineral insulated heating cable comprising two electrical conductors extending along the lengths of the cable and an array of heating elements distributed along the length of the cable and connected in parallel between the conductors. The heating cable is encased in a metal jacket which waterproofs the overall assembly, the jacket being electrically insulated from both the conductors and the heating elements by for example mica or glass fiber tape sheaths. The metal jacket is extruded directly onto the heating cable, or is extruded around and then drawn down onto the heating cable. Thus the structure can withstand high temperatures and yet is waterproof given the provision of the metal jacket.

12 Claims, 3 Drawing Sheets

HEATING CABLE

CROSS-REFERENCE TO RELATED APPLICATIONS

This application claims priority under 35 U.S.C. §119 to Great Britain Patent Application No. 0025734.5 filed Oct. 19, 2000 and Great Britain Patent Application No. 0031857.6 filed Dec. 30, 2000.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a heating cable for use in electric trace heating applications.

2. Description of the Related Art

Trace heating cables fall into two general categories, that is parallel resistance cut-to-length types and series resistance fixed length types.

In parallel resistance type cables, generally two insulated conductors (known as buswires) extend longitudinally along the cable. A resistance heating wire is spiraled around the conductors, electrical connections being made alternately at intervals along the longitudinally extending conductors. This creates a series of short heating zones spaced apart along the length of the cable. The heating wire must be selectively insulated from the conductors and also encased within an insulating sheath. Available parallel trace heating cables either use polymeric external insulation sheaths which limit the use of such cables to maximum temperatures of for example 250° C., or use glass insulation for the external sheath which can operate at higher temperatures, for example above 400° C., but which are not waterproof.

Series resistance heaters must be specifically designed so that the power produced meets the requirements for a particular length of cable. This is not convenient and represents a major constraint. Generally series heaters include longitudinally extending resistance wires embedded in a mineral insulation which can withstand high temperatures. A typical construction comprises two ni-chrome heating conductors, magnesium oxide powder insulation, and an outer stainless steel sheath. The whole construction may be drawn down from an outside diameter of typically 80 mm to an outside diameter of 4 mm at which point the heater is flexible to enable it to be installed relatively easily and has an electrical resistance producing a desired output per unit length. Unfortunately the available range of resistances is limited and, particularly, short lengths (typically less than 10 meters) with appropriate low power outputs are not available.

In summary, parallel heaters are convenient in use but are not available in forms which combine both a high temperature withstand and a waterproof construction, whereas series heaters are available which can withstand high temperatures and are waterproof but cannot be cut to length and therefore must be designed specially to fit particular applications and are difficult to design for use in short lengths.

It is an object of the present invention to obviate or mitigate the problems outlined above.

BRIEF SUMMARY OF THE INVENTION

According to the present invention, there is provided a mineral insulated heating cable comprising two electrical conductors extending along the length of the cable and an array of heating elements distributed along the lengths of the cable and connected in parallel between the conductors, wherein each conductor is encased in an inner sheath of insulating material through which connections are made to each heating element, the inner sheaths and heating elements are encased in an outer sheath of insulating material and the outer sheath is covered by a metal jacket extruded around the outer sheath.

The term "mineral insulated" is used herein to indicate a heating cable in which all components can withstand long-term exposure to high temperatures, e.g. 250° C. and above. In such cables, insulation could be formed from for example tape manufactured from glass and/or mica.

The invention is based on the realization that with careful process control it is possible to extrude a jacket of for example aluminum onto a preformed trace heating cable of the parallel resistance type, the aluminum sheath making the overall assembly waterproof and therefore enabling the use within the cable of components which themselves do not have to be waterproof. A waterproof structure which can withstand high temperatures results.

The conductors and the inner sheaths may be encased in an intermediate sheath of insulating material through which connections are made between each conductor and each healing element, the intermediate sheath may be formed from glass tape which may be coated with a stabilizer.

The conductors may be nickel plated copper, the heating elements may be formed from a ni-chrome resistance heating wire spiraled around the conductors, and the resistance heating wire may be in contact with the conductors through openings in the inner sheath such that the wire touches the conductors, a positive electrical connection being made between the conductors and the wire by sprayed metal. Metal may be sprayed onto the conductors both before and after positioning of the heating wire.

Each inner sheath may be formed from mica tape and the outer sheath may also comprise mica tape. The outer sheath may also comprise glass tape which may be coated with a stabilizer. The stabilizer may be for example silicone varnish to provide initial waterproofing, or a ceramic fiber adhesive incorporating a rigidizer and hardener.

The metal jacket may be of oval section to improve overall flexibility of the product.

BRIEF DESCRIPTION OF THE SEVERAL VIEWS OF THE DRAWINGS

An embodiment of the present invention will now be described, by way of example, with reference to the accompanying drawings, in which.

DETAILED DESCRIPTION OF THE INVENTION

Figure 1:
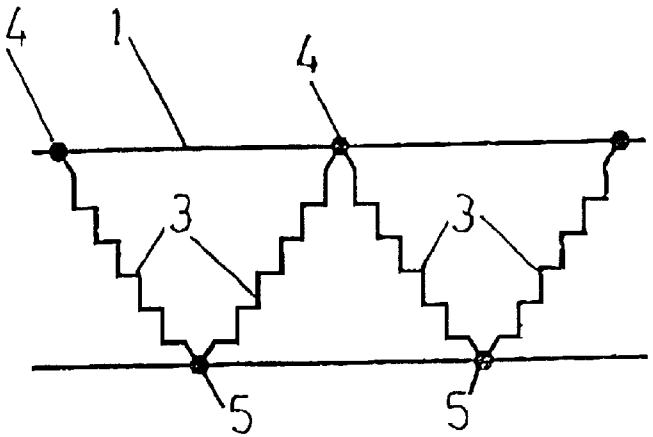
FIG. 1 is a schematic illustration of the electrical structure of a parallel resistance trace heating cable in accordance with the present invention.

Referring to FIG. 1, the illustrated structure comprises two conductors 1, 2 between which a series of heating elements 3 are connected. One end of each heating element is connected to a node 4 on conductor 1 whereas the other end of each heating element is connected to a node 5 on conductor 2.

Figure 2:
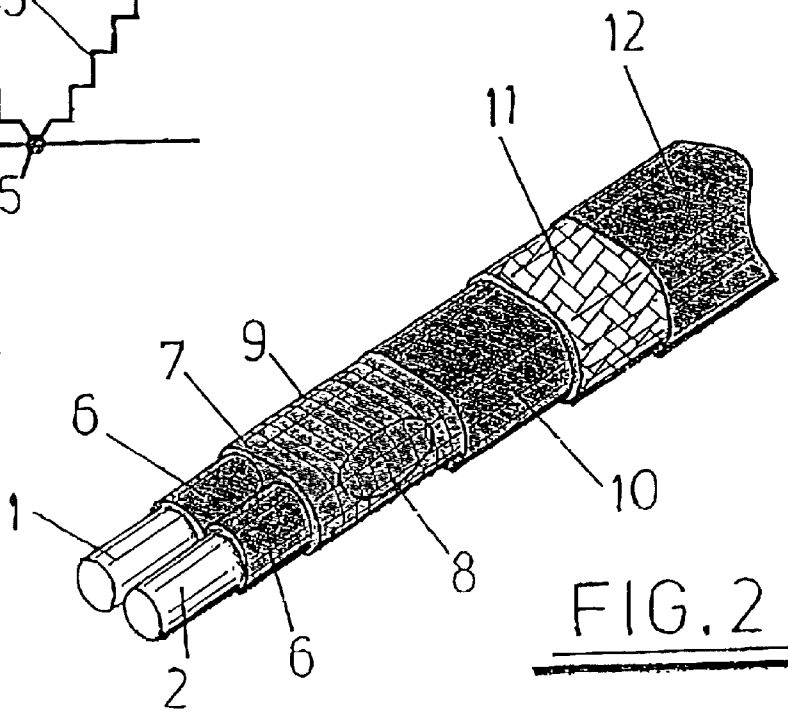
FIG. 2 illustrates a known parallel resistance trace heating cable incorporating polymeric components.

FIG. 2 illustrates a known structure resulting in an electrical arrangement as illustrated in FIG. 1. The known cable comprises conductors 1 and 2 each received within an insulating sheath 6 of polymeric material. The two conductors are enclosed within a further sheath 7. Openings 8 are formed through the sheath 6 and 7 so as to expose the underlying conductors 1, 2 and a ni-chrome heating wire 9 is spiralled around the outside of the sheath 7 so as to contact the conductors through the openings 8. Thus the heating elements 3 of FIG. 1 correspond to the lengths of wire 9 between successive opening 8. Typically the openings 8 will have an axial length of about 20 mm and be spaced apart along the length of the cable by 750 mm.

The heating wire 9 is covered with an inner polymeric jacket 10 wrapped in a braided jacket 11 encased in a polymeric sheath 12. Thus the overall structure is flexible and waterproof but cannot be used at high temperatures, for example temperatures in excess of 250° C., because such usage would result in damage to the polymeric components.

Figure 3:
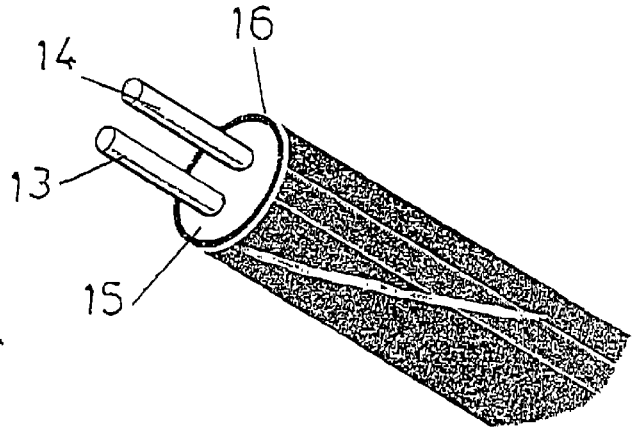
FIG. 3 is a schematic representation of a known series resistance trace heating cable.

Referring to FIG. 3, the illustrated structure comprises two heating wires 13 and 14 embedded in a mineral insulating material 15 encased within an outer metal sheath of copper, stainless steel or nickel-based alloy. The heat output per unit length of such cables is a function of the composition and current through the conductors 13 and 14 and thus it is difficult to fabricate short lengths of appropriate low power and the cable cannot simply be cut to length to fit particular circumstances.

Figure 4:
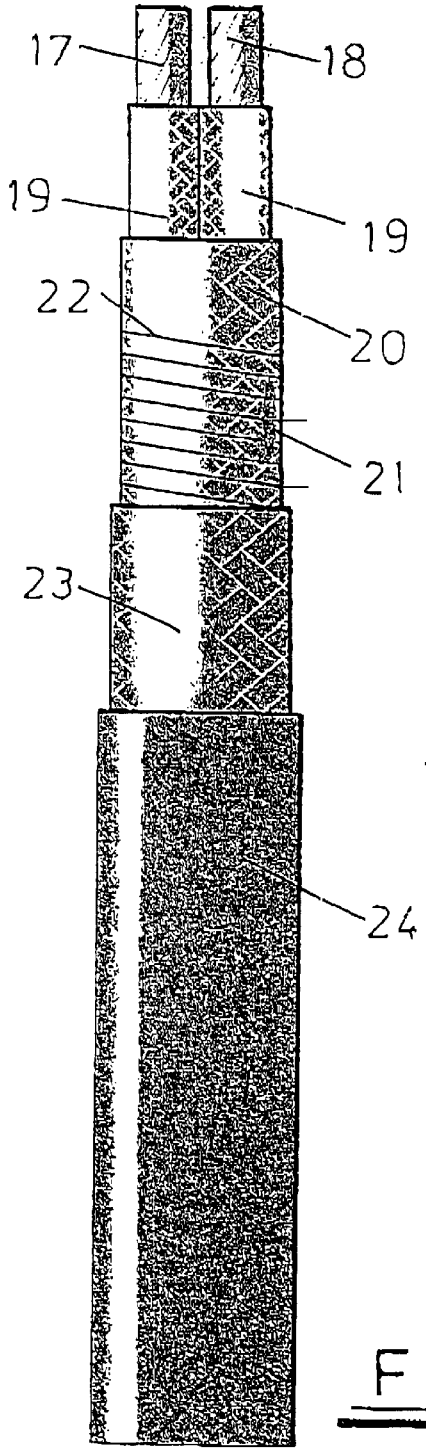
FIG. 4 is an illustration of a cable in accordance with the present invention.

Referring now to FIG. 4, the illustrated embodiment of the invention comprises two conductors 17, 18 each of which is covered with two layers of high temperature mica insulation tape 19 and each of which is also restrained by a high temperature glass fibre tape layer 20. Openings 21 are formed through the insulation layers 19 and 20 to enable the conductors to be contacted by a ni-chrome resistance heating wire 22 which is spiralled around the outside of the sheath 20.

The wire 22 is covered with two layers of mica tape and an outer layer of glass fibre tape to form an insulation layer 23 which in turn is covered with an aluminium sheath 24.

Thus all of the components of the cable illustrated in FIG. 4 can withstand high temperatures and yet the overall assembly is waterproof as a result of the provision of the outer aluminium jacket 24.

The conductors 17 and 18 may be nickel plated copper, but could also be of aluminium. There are advantages in fabricating the conductors 17 and 18 and the jacket 24 from the same material (e.g. aluminium) to avoid differential expansion between the conductors and the jacket. The intermediate sheath 20 may be covered with a stabiliser to provide moisture proofing and robustness during processing.

The openings 21 may be as in prior art devices, for example typically 20 mm in axial length with a space between openings of 750 mm. The wire 22 may be spiralled around the conductors with typically eight spirals per centimeter. With such an arrangement typically ten or more spirals of resistance wire make touch contact to the conductor 17 and 18. To improve the reliability of the resultant electrical connection, the contact areas between the conductors 17 and 18 and the wire 22 may be sprayed with metal, for example aluminium, zinc or an aluminium/zinc alloy. This forms a positive electrical connection. Preferably, the conductors 17 and 18 are sprayed before the wire 22 is positioned and the contact areas are sprayed again after the wire 22 is positioned.

The final insulating layer 23 which is in the form of two layers of taped mica over which, a single layer of taped glass fibre is wrapped may be coated with a stabiliser for moisture protection and to improve robustness during processing.

The stabiliser may be a simple silicone varnish or a high temperature resistant rigidiser designed to resist damage during processing and to provide initial waterproofing. A suitable rigidiser would be the product "901/901A ceramic fibre adhesive" incorporating a liquid insulation hardener which product is available from Symonds Cableform Limited, Welwyn Garden City, United Kingdom.

The assembly shown in FIG. 4 up to and including the sheath 23 is passed through an aluminium extruder such that the aluminium jacket 24 is extruded around the other components, forming a unitary product which is provided with reliable waterproofing by virtue of the provision of the aluminium jacket 24 and yet which only comprises components which can withstand high temperatures. Preferably the jacket 24 is of oval cross-section to improve the contact between the cable and a supporting surface and to improve the flexibility of the product.

Figure 5:
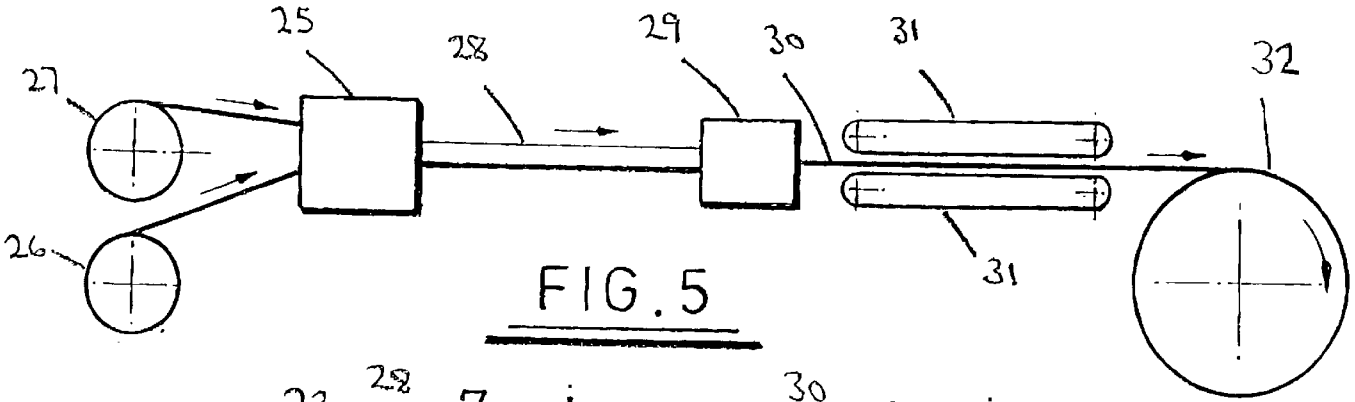
FIG. 5 is a schematic illustration of a production line for producing a cable as illustrated in FIG. 4.

The aluminium jacket 24 may be extruded directly onto the sheath 23, but preferably is initially extruded so as to be of relatively large dimensions and then drawn down through a draw down device to be a close fit on the jacket 23. FIG. 5 illustrates a production line which incorporates such a draw down device.

Referring to FIG. 5, the schematically illustrated production line comprises an extruder 25 to which aluminium to be extruded is supplied from a roll 26 and to which cable incorporating all the components 17 to 23 of FIG. 4 (but not the aluminium jacket 24) is supplied from a roll 27. The extruder 25 may be of conventional type, for example a "conform" machine arranged to produce an oval extrusion 28 the internal dimensions of which are greater than the external dimensions of the cable delivered from the roll 27. Thus, the extrusion 28 is a loose fit on the sheath 23.

The "oversize" extrusion 28 is drawn down in a draw down device 29 to produce a final product 30 which corresponds to the cable structure illustrated in FIG. 4 in which the aluminium jacket 24 is a close fit on the sheath 23. The cable 30 is pulled through the production line by conveyors 31 and wound onto a roll 32.

Figure 6:
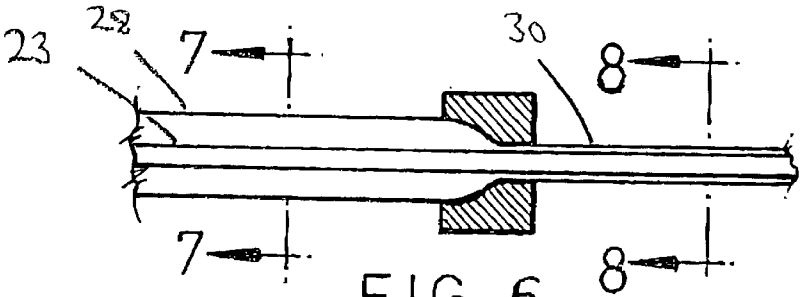
FIG. 6 is a schematic illustration of a draw down device incorporated in the production line of FIG. 5.
Figure 7:
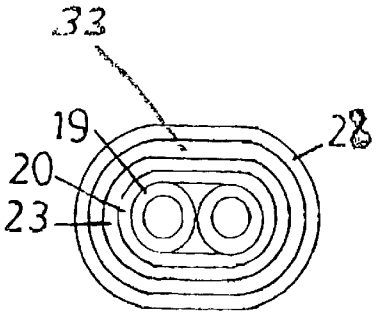
FIGS. 7 and 8 are respectively sections on the lines 7—7 and 8—8 of FIG. 6.
Figure 8:
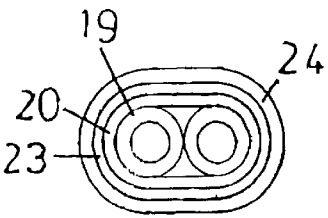

Referring to FIG. 6, this shows the outer sheath 23 of the cable delivered from the roll 27. Upstream of the draw down device 29, the outer aluminium sheath 28 has dimensions such that a gap 33 is defined between the sheath 23 and the extrusion 28 as shown in FIG. 7. Downstream of the draw down device 29, the extrusion 28 has been converted into the close-fitting outer aluminium jacket 24 as shown in FIG. 8.

Although in the described process a single draw down device is provided, it will be appreciated that two or more draw down devices could be provided in series to progressively reduce the dimensions of the initially extruded jacket.

I claim:

1. A mineral insulated heating cable comprising two electrical conductors extending along the length of the cable and an array of heating elements distributed along the length of the cable and connected in parallel between the conductors, wherein each conductor is encased in an inner sheath of insulating material through which connections are made to each heating element, the inner sheaths and heating elements are encased in an outer sheath of insulating material, and the outer sheath is covered by a metal jacket extruded around the outer sheath.

2. A heating cable according to claim 1, wherein the conductors and the inner sheaths are encased in an intermediate sheath of insulating material through which connections are made between each conductor and each heating element.

3. A heating element according to claim 2, wherein the intermediate sheath is formed from glass tape.

4. A heating element according to claim 2, wherein the intermediate sheath is coated with a stabilizer.

5. A heating element according to claim 3, wherein the intermediate sheath is coated with a stabilizer.

6. A heating cable according to claim 1, wherein the conductors are nickel plated copper, the heating elements are formed from a ni-chrome resistance heating wire spiralled around the conductors, and the resistance heating wire is in contact with the conductors through openings in the inner sheaths such that the wire touches the conductors, a positive electrical connection being made between the conductors and the wire by sprayed metal.

7. A heating cable according to claim 1, wherein each inner sheath is formed from mica tape.

8. A heating cable according to claim 1, wherein the outer sheath comprises mica tape.

9. A heating cable according to claim 1, wherein the outer sheath comprises glass tape.

10. A heating cable according to claim 8, wherein the glass tape forms an outer component of the outer sheath and is coated with a stabilizer.

11. A heating cable according to claim 1, wherein the metal jacket is of oval section.

12. A heating cable according to claim 1, wherein the metal jacket is of aluminum.

* * * * *